United States Patent [19]

Hemphill

[11] Patent Number: 4,727,664

[45] Date of Patent: Mar. 1, 1988

[54] DIGGING TOOTH AND HOLDER THEREFOR

[75] Inventor: Charles W. Hemphill, Duncanville, Tex.

[73] Assignee: Hemphill Industries, Inc., Mansfield, Tex.

[21] Appl. No.: 883,643

[22] Filed: Jul. 9, 1986

[51] Int. Cl.[4] ..... E02F 9/28

[52] U.S. Cl. ..... 37/142 R

[58] Field of Search ..... 37/141 R, 141 T, 142 R, 37/142 A; 299/86, 91–93

[56] References Cited

U.S. PATENT DOCUMENTS

| | | | |
|---|---|---|---|
| T103,602 | 11/1983 | Rettkowski | 299/10 |
| 2,916,275 | 12/1959 | Bruestle et al. | 262/33 |
| 3,117,386 | 1/1964 | Fernerda | 37/142 R |
| 4,316,636 | 2/1982 | Taylor et al. | 299/92 |
| 4,335,921 | 6/1982 | Swisher, Jr. et al. | 299/86 |
| 4,346,934 | 8/1982 | College et al. | 299/92 |
| 4,595,241 | 6/1986 | Gilbert et al. | 299/93 |
| 4,611,417 | 9/1986 | Carlson | 37/142 A X |

FOREIGN PATENT DOCUMENTS

| | | |
|---|---|---|
| 1275498 | 8/1968 | Fed. Rep. of Germany . |
| 1101085 | 1/1968 | United Kingdom . |

*Primary Examiner*—Clifford D. Crowder

*Attorney, Agent, or Firm*—Marcus L. Bates

[57] ABSTRACT

An excavating machine has a plurality of tooth receiving support blocks mounted for movement thereon to enable an excavating operation to be carried out when digging teeth are mounted to the blocks. Each support block has a cylindrical bore for receiving the cylindrical shank of a prior art rotatable type bit. The present improvements provide the combination of said support block with a non-rotatable dirt type excavating tooth. The tooth includes a cylindrical shank at one end thereof made complementary respective to the block bore so that the shank can be telescopingly received in a captured manner within the bore of the support block, thereby mounting the excavating tooth to a block. A stop means is formed on said block for engaging an abutment means of the tooth and prevents axial rotation of the tooth when the shank is received within the bore. The tooth can be removed from the block, axially rotated into one of a plurality of axial positions respective to the block, and mounted within the bore of the support block.

18 Claims, 17 Drawing Figures

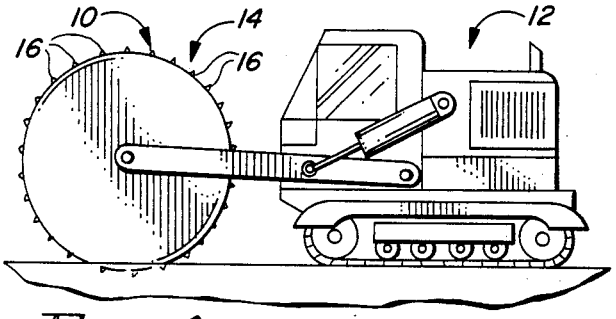
FIG. 1
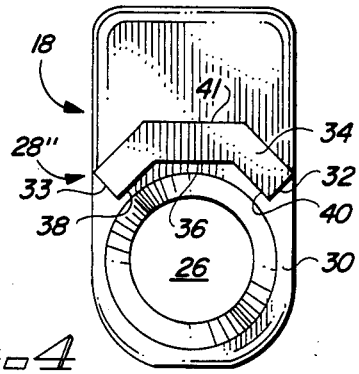
FIG. 4
FIG. 2
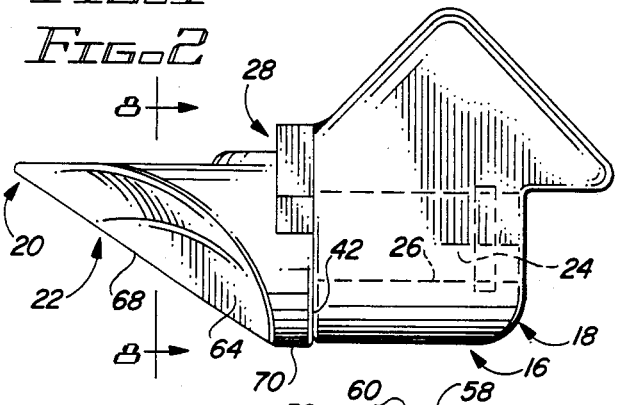
FIG. 5
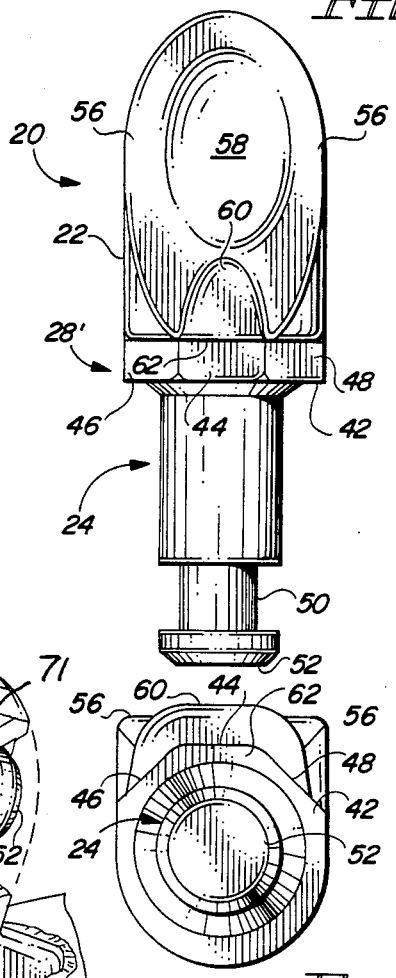
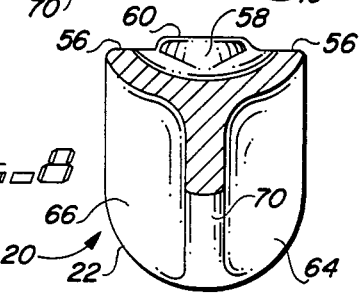
FIG. 8
FIG. 6
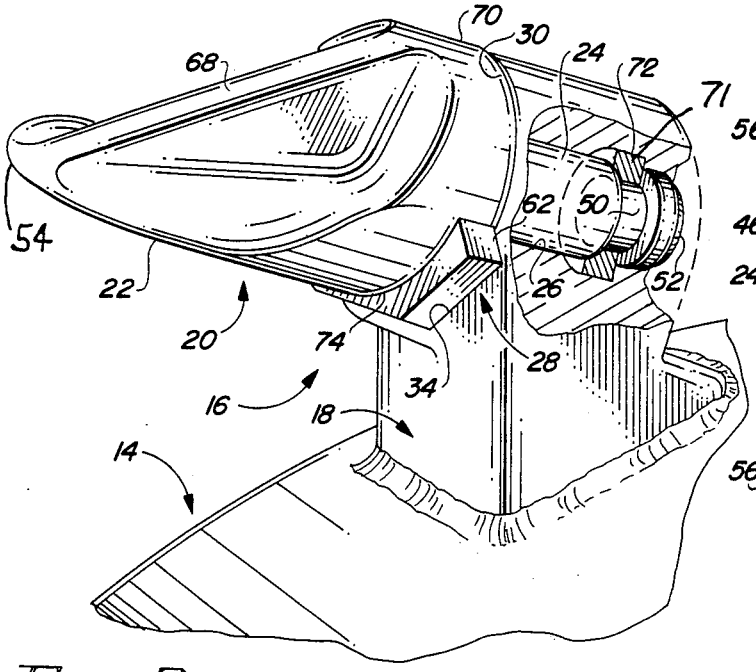
FIG. 3
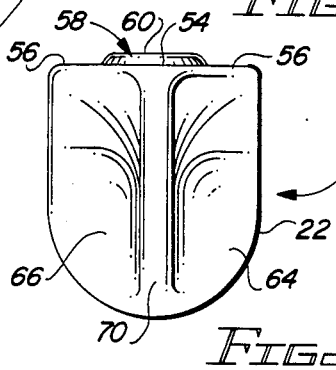
FIG. 7

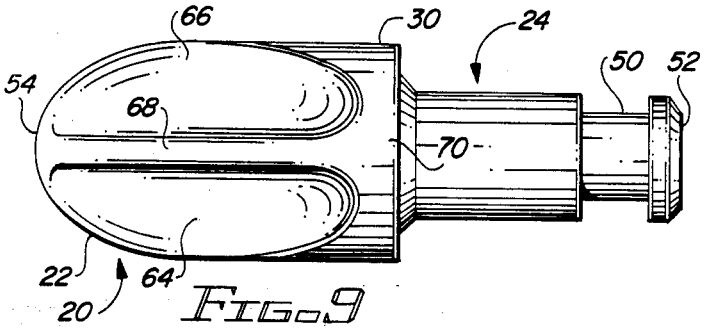
FIG. 9
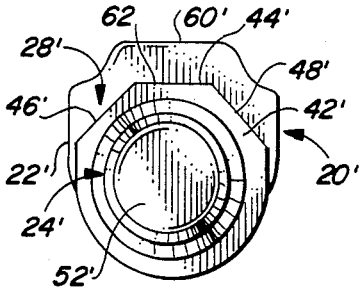
FIG. 10
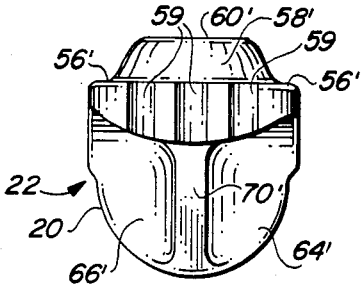
FIG. 11
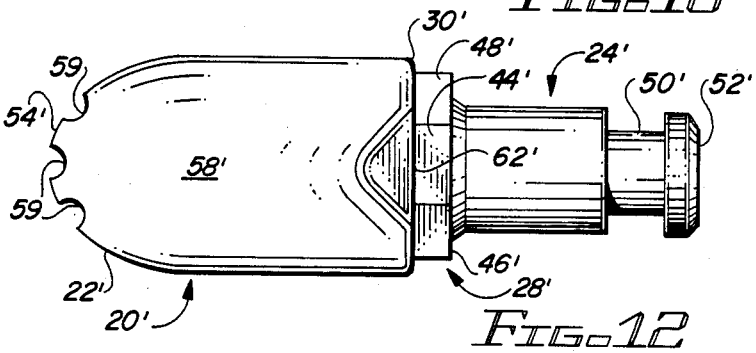
FIG. 12
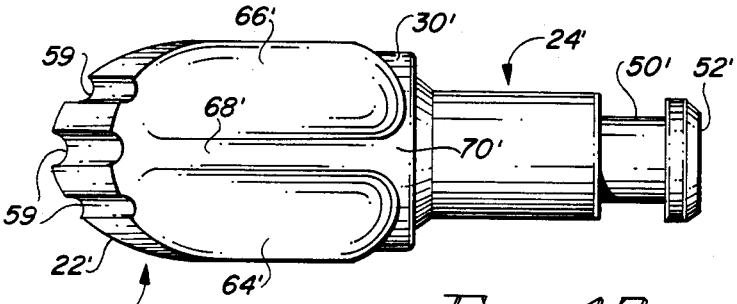
FIG. 13
FIG. 15
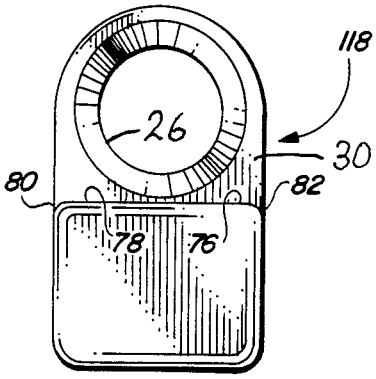
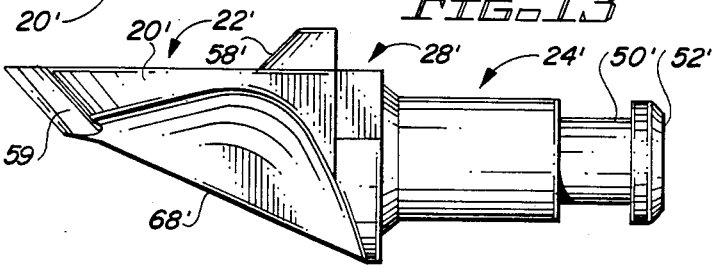
FIG. 14
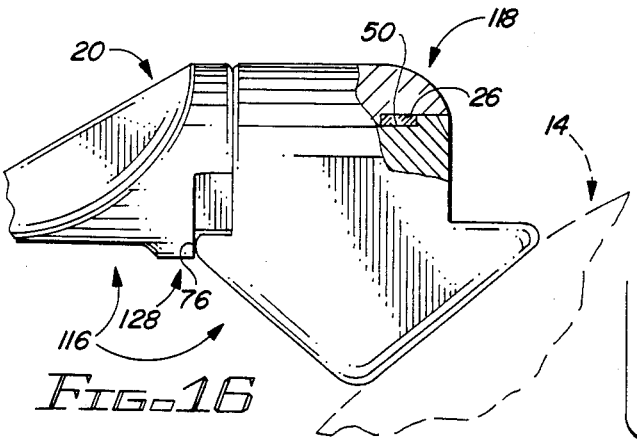
FIG. 16
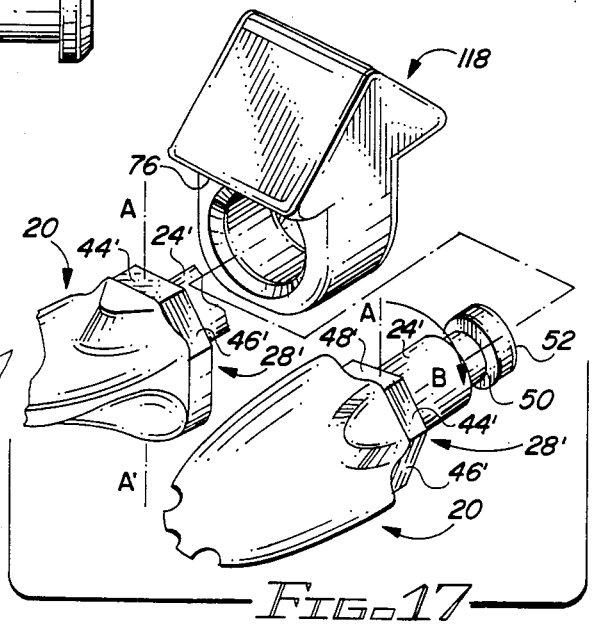
FIG. 17

DIGGING TOOTH AND HOLDER THEREFOR

BACKGROUND OF THE INVENTION

Excavating machines for digging in rock type formations usually employ a combination digging tooth and holder comprised of a rock type bit having a shank which is rotatably received within a bore formed within a block. The block is a body of metal that is welded onto whatever mechanism the excavating machine may employ for manipulating the digging teeth. For example, in a wheel type digging machine, the blocks will be welded to the outer circumferentially extending surface of the digging wheel so that the digging teeth engage and remove the geological formation being traversed by the machine.

During the excavation of geological material from the earth, it is not uncommon to observe the formation change from a rock type formation to dirt, sand, clay, or other soft formations that do not require a rock type bit. In fact, a rock type bit does not perform satisfactorily in these loose, dirt type formations and it is therefore necessary to either change the digging teeth to a wider, more efficient dirt type tooth, or change to a machine that includes the appropriate digging teeth.

It would therefore be advantageous to be able to change the digging teeth associated with a digging machine from a rock type bit to a dirt type digging tooth, and vice versa, depending upon the formation encountered by the digging machine. To be able to quickly change from a rotatable rock type tooth to a wide, non-rotatable, dirt type tooth requires that means be provided by which the dirt type tooth is rendered non-rotatable, and this non-rotatable tooth is the subject of this invention.

PRIOR ART STATEMENT

Rettkowski U.S. Pat. No. T103,602 in FIG. 8 shows a rock digging tooth along with a holder. The tooth is alternately moved into cutting and non-cutting positions relative to the holder as seen in FIGS. 8 and 9. The tooth shank is held within the tooth socket for limited longitudinal forward movement toward the non-cutting position and limited rearward movement toward the cutting positions. Mutually engageable surfaces 40, 42 prevent rotation of the cutting element 10 in the non-cutting position of FIG. 8. This reference does not anticipate Applicant's contribution because an ordinary prior art rotatable tooth, such as seen in FIG. 1 of Rettkowski, cannot be used in the modified holders seen in FIGS. 8 and 9 or 16 and 17.

College et al U.S. Pat. No. 4,346,934 shows a non-rotatable bit having an abutment shoulder formed at the juncture of the shank and ground engaging end of the tooth, with there being a tang which extends from the shoulder that mates with a surface of the support block. This holds the bit non-rotatable in a support block. The support block will accept rotatable type rock bits. This reference fails to anticipate Applicant's contribution for the reason that both the support block and the digging tooth of Applicant's disclosure is made so that the digging tooth is received in a non-rotatable manner within the support block in a plurality of different angular positions respective to the normal digging position.

Swisher, Jr. et al U.S. Pat. No. 4,335,921 in FIGS. 6 and 7 shows a cutting tooth having a shank received within a support block. The support block has circular bores and at least one shoulder positioned such that a cutter designed for rotation will clear the shoulder. Cutters 162, designed for non-rotating use, are provided with lugs 168 forming shoulders which mate with the shoulders on the support block to prevent rotation. Accordingly, this reference is similar to College et al in many respects, and Applicant's disclosure differs therefrom for the above recited reasons.

Taylor et al U.S. Pat. No. 4,316,636 shows a rock bit and support block wherein the shank of the bit has a flat portion that renders it non-circular in cross-sectional configuration, so that when the shank is placed within the support block having a complementary bore of similar size and shape, the bit will not rotate in the block. This does not anticipate Applicant's invention because Applicant's support block has a bore formed therein for rotatably accepting the shank of a rock bit.

Bruestle et al U.S. Pat. No. 2,916,276 in FIGS. 13 and 14 shows a bit having a round shank 57 and a cavity formed by members 65 for capturing a part of the digging tooth and rendering the digging tooth non-rotatable. Also note FIGS. 9 and 10 which show another embodiment of this concept. Bruestle et al obviously is not the type of support block designed for rotatably receiving a rock type digging tooth and therefore does not anticipate Applicant's claimed invention.

British patent No. 1,101,085 and French patent No. 92,923 are similar in design, each discloses lugs 20 formed on the bit holder for engaging complementary shoulders formed on the digging tooth. This is best seen in FIG. 2 of the French patent. Neither of these references are anticipatory of Applicant's invention because they do not appear to be for a bit holder that can accept a rotatable rock bit, and at the same time, a dirt type bit can be rendered non-rotatable and selectively placed in a plurality of axial positions.

The German patent No. 1,275,498 discloses a support block that receives shank 4 of a digging tooth having a blade type ground engaging member 5. There appears to be coacting shoulders between the juncture of blade 5, shank 4, and block 2. The configuration of this confronting shoulder is not known since there is only one figure of the drawings. Applicant has not translated this document because there appears to be no teaching contained in this reference whereby block 2 could be of the type that rotatably receives a rock bit, and at the same time a non-rotatable digging tooth could be employed therein which is releasably fastened into one of a plurality of different axial positions.

The Gilbert U.S. Pat. No. 4,595,241 and the Carlson application Ser. No. 586,439 filed Mar. 5, 1984 each fail to anticipate Applicant's contribution because neither can be axially rotated into a plurality of different digging positions. Both Gilbert and Carlson have coacting stop members that prevent rotation of the tooth and holds the tooth in a single upright position, whereas Applicant can position his tooth respective to the block bore wherein the tooth is rotated either clockwise or counterclockwise from the upright position.

SUMMARY OF THE INVENTION

A non-rotating digging tooth in combination with a support block therefor, wherein the block has a bore adapted to removably receive a rotatable rock-type bit therein. A plurality of shoulders formed at a medial part of the non-rotatable tooth engages a forwardly projecting shoulder formed on the block, with the tooth shoulder and box shoulder abuttingly confronting one another when the tooth shank is removably mounted in the bore formed within the block. The block bore is cylindrical and is made complementary respective to the cylindrical tooth shank.

In another form of the invention, the block shoulder is a relief which forms an inwardly directed face. The face is spaced from and lies parallel to the longitudinal axial centerline of the block bore. This construction allows a combination dirt type digging tooth and block made in accordance with this invention to be used on various different excavating apparatus, so that dirt, for example, can be efficiently excavated, and when the geology of the ground changes into a hard formation, a rotatable rock-type bit can be substituted for the dirt type tooth and rotatably captured within the bore of the block, thereby enabling the rock-type formation to be efficiently penetrated by the rock bit. Thereafter, the dirt type digging tooth of the combination can be replaced within the box as may be desired.

The plurality of tooth shoulders form three sides of an octagon, and either of the three sides can be received against the forwardly projecting shoulder formed on the block, thereby enabling the tooth to be positioned in the upright position, or in a position rotated 45° clockwise or counterclockwise, for example.

In another embodiment of the invention, the forwardly projecting relief of the block also forms three sides of an octagon and is made complementary respective to the tooth shoulders so that the tooth shoulders are received within the block shoulders.

Accordingly, a primary object of the present invention is the provision of an improved combination block and tooth assembly, wherein a dirt type digging tooth is held non-rotatable respective to the block, with the block bore being of a configuration to also admit the use of a rotatable rock bit type therewith.

Another object of the present invention is the provision of a dirt type digging tooth for use in combination with a block having a circular bore, wherein means are provided to prevent relative rotation between the tooth and block, with the block bore being of a design which admits the use of a rotatable type tooth therewith.

A still further object of the present invention is the provision of an improved dirt type digging tooth which is non-rotatably affixed to a support block, with the support block having a forwardly projecting relief that forms a shoulder against which there is received one of a plurality of shoulders formed on a medial part of the digging tooth, so that the digging tooth is non-rotatably captured in several different positions and in a removable manner within the box.

Another and still further object of the present invention is the provision of improvements in non-rotatable type digging teeth for use on digging machines, comprising a tooth and block combination wherein the block has a circular bore formed therein for receiving either a non-rotatable dirt-type digging tooth as well as a rotatable type rock bit, with the non-rotatable type tooth having a plurality of shoulders formed either of which abuttingly engages at least one shoulder formed on the block, with there being an interface between the shoulder of the block and tooth which lie in spaced relationship and parallel to the longitudinal axial centerline of the block bore.

An additional object of the present invention is the provision of an improved non-rotatable digging tooth for use in a support block of the type which is designed to receive a rotatable type rock bit therein, wherein the non-rotatable digging tooth has means located thereon which abuttingly engages means located outside of the block bore so that part of the tooth abuttingly engages part of the block and thereby prevents relative axial rotational motion therebetween, and yet enables the tooth to be repositioned axially into a number of different digging positions.

A further object of the present invention is the provision of an improved non-rotatable digging tooth having a flat ground engaging end made into a cross-sectional configuration which increases in thickness towards a cylindrical shank, and is worn away in a manner which retains a cutting edge; with the shank being removably received within a cylindrical bore of a support block, and with there additionally being coacting confronting shoulders formed on the digging tooth and the support block which confront one another and thereby prevents relative rotation of the tooth respective to the block.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

BRIEF DESCRIPTION OF THE DRAWINGS

FIG. 1 is a side elevational view that diagrammatically illustrates a prior art digging machine;

FIG. 2 is a greatly enlarged, side view of a combination digging tooth and block seen illustrated in FIG. 1 and made in accordance with the present invention;

FIG. 3 is a greatly enlarged, fragmentary, part cross-sectional, side elevational view of part of the apparatus seen in FIG. 1;

FIG. 4 is a front end view of a block which forms part of the apparatus disclosed in FIGS. 2 and 3;

FIG. 5 is a top, plan view of a tooth which forms part of the apparatus disclosed in FIGS. 2 and 3;

FIG. 6 is a rear view of the tooth of FIG. 5;

FIG. 7 is a front view of the tooth in FIG. 5;

FIG. 8 is a cross-sectional view taken along line 8—8 of FIG. 2;

FIG. 9 is a bottom view of the tooth of FIG. 5;

FIG. 10 is an end view of a modification of the tooth disclosed in the foregoing figures;

FIG. 11 is a front view of the tooth disclosed in FIG. 10;

FIG. 12 is a top, plan view of the tooth disclosed in FIG. 10;

FIG. 13 is a bottom view of the tooth disclosed in FIG. 10;

FIG. 14 is a side, elevational view of the tooth disclosed in FIG. 13;

FIG. 15 is a front, end view of a modification of a block such as seen in FIGS. 3 and 4;

FIG. 16 is a side elevational view which illustrates the block of FIG. 15, along with the tooth of FIG. 5; with some parts being removed therefrom and the remaining parts being shown in cross-section; and, FIG. 17 illustrates a block and tooth of this invention moved into two alternate positions of operation.

DETAILED DESCRIPTION OF THE PREFERRED EMBODIMENTS

In FIG. 1 of the drawings, there is disclosed an excavating machine 10, such as a trencher, that includes the usual prior art ground supported vehicle 12, which can take on any number of different forms. The vehicle has attached thereto a digging member 14, which can be in the form of a wheel, or a ladder, or endless chain type ditching machine, as well as other digging members. The digging member 14 includes a plurality of digging teeth and blocks 16 mounted on the earth engaging surface thereof for excavating material from the ground.

As seen in FIG. 2, together with other figures of the drawings, the tooth and block combination 16 includes a block 18 by which a tooth 20 is removably mounted to the digging member 14. The tooth 20 has a digging end 22 and a mounting or shank end 24; while the block 18 has a bore 26 which receives the shank 24 of tooth 20 therewithin. The block bore 26 is of a configuration to rotatably receive a rock type bit in captured relationship therein, such as the Kennametal, Inc. bit seen in Engle et al U.S. Pat. No. 3,519,309, for example.

As seen in FIGS. 2–9, a locking device 28 releasably locks the tooth 20 against axial rotation respective to the bore 26. A shoulder or annular face 30 is formed on the forward end of the block and has extending forwardly therefrom a female abutment member 32 which forms part 28″ of the block locking device 28. The female abutment member 32 includes internal faces of an octagon seen illustrated at 36, 38, and 40 that form an included angle of 135° therebetween. Other polygons, in addition to the octagon, can be advantageously employed; however, the included angle between faces 36, 38, and 40 of the locking device 28″ preferably will always be an obtuse angle of 120°–135° and preferably 135°such as found in an octagon.

As specifically illustrated in FIG. 5, the tooth part of the locking device 28 includes a male abutment member at 28′ made complementary respective to a female abutment member 28″ found on the block 18 of FIG. 4. Face 42 of the tooth male abutment member 28′ abuttingly engages face 30 of the block 18. The male abutment member 28′ of locking device 28 comprises a plurality of outwardly directed external faces 44, 46, 48 which are slidably received in close tolerance relationship within the female abutment member 28″ and confront the faces 36, 38, 40 of the female abutment member when the tooth shank 24 is suitably received in slidable relationship within the bore 26 of block 18.

A keeper groove 50 is located at the far marginal end of the shank 24 adjacent to rear terminal end 52 thereof. The forward end of the tooth 20 terminates in a front tip 54 which is opposed to the rear terminal end 52. The upper surface of the tooth has a dished out central area 58 formed by a raised area seen at 56 and 60. The rear face 62 adjacent to the locking device part 28′ abuttingly engages the face 34 of the locking device part 28″ of the block. Hence, face 34 abuts face 62, and faces 34, 42 confront one another, when the tooth and block are properly assembled.

As particularly seen illustrated in FIGS. 3 and 7, the complex undersurface of the tooth includes opposed concave or dished out areas 64, 66, which leaves a structural reinforcing member in the form of a curved rib 68 that extends from tip 54 to the rounded bottom 70 of the tooth.

As seen in FIG. 3, the internal groove 72 of the block and external groove 50 of the tooth cooperate with the symbolically illustrated keeper 71 located within the grooves 50 and 72 and thereby rotatably captures the shank of a rock type bit therewithin when it is desired to use this type tooth. This arrangement therefore keeps either the dirt type tooth of the present invention and the rock type tooth of others' invention from being inadvertently separated from the block bore. The tooth 20 of this invention can be removably received in captured relationship within either of the blocks 18 or 118 illustrated herein, as will be more fully discussed later on in this disclosure.

FIGS. 10–17 of the drawings, illustrate another embodiment 116 of the present invention. In FIGS. 10–17, wherever it is practical or logical to do so, like or similar numerals apply to like or similar elements. The digging tooth 20′ of FIGS. 10–14 is non-rotatably received within the bore of either of the blocks 18 or 118 illustrated in the drawings of the present invention.

FIGS. 15–17 of the drawings include an illustration of another embodiment 118 of the block. As specifically seen in FIG. 15, the block 118 has a bore 26 therethrough for receiving the shank 24′ of either a rock type prior art rotatable type tooth or a dirt type tooth 20 or 20′ seen in various ones of the foregoing figures. The locking device formed between the tooth 20′ and block 118 comprises a horizontal outward extension 76 which extends forwardly from the front face 30 of the block, and extends from side 80 to the opposed side 82 of the block 118. A flat horizontal shoulder 78 is formed by the extension 76 and slidably receives one of the plurality of surfaces 44, 46, 48 of the tooth 25 20′ in confronting relationship therewith. That is, shoulder 46 or 46′, for example, confronts shoulder 78 of the block and there by prevents axial rotation of the tooth 20 or 20′. The tooth 20′, as seen in FIG. 17, can be removed from the block bore 26, rotated to the right or left, thereby bringing either of the other shoulders 42 or 46 into engagement with the shoulder 78 of the block, as seen illustrated in the drawings. Accordingly, the tooth 20 or 20′ can be rotated clockwise or counterclockwise into either of three positions, that is, the upright position, turned 45° to the left, or turned 45° to the right.

Those skilled in the art, having digested this disclosure, will appreciate that the included angle between 44, 46, or 44, 48 can be arranged to rotate the tooth other than 45° while remaining within the scope of the claims of this invention.

In operation, while digging with a prior art rock type bit, should a softer or dirt-like geological formation be encountered, the illustrated teeth 20 or 20′ can be substituted for the prior art rock bit. This is easily accomplished by removing the rock bit from bore 26 and forcing the tooth 20 or 20′ of this invention into the position illustrated in FIGS. 2, 3, and 16.

In many instances, it is desirable to be able to rotate the tooth 20 or 20′ axially from the normal upright position. The present invention allows this desirable novelty to be achieved by removing the tooth from the bore 26 and placing a tooth 20 or 20′ within the bore in a rotated position as suggested in FIG. 17. The tooth can be rotated clockwise or counterclockwise into the desired position, thereby removing earth in a manner different from the upright position. Various teeth located on the digging implement may be arranged at various different angles respective to one another in order to achieve various different digging patterns or actions.

The digging tooth of this invention is of a configuration that wears or abrades in a manner that retains a sharp leading edge. As the free end of the tooth is progressively abraded away, the tooth retains a suitable digging end at 54 or 59 because of the configuration seen in the cross-sectional view of FIG. 8, and the configuration seen in the cross-sectional views of FIGS. 3 and 14.

The wear pattern of the teeth 20 or 20' is essentially as illustrated in FIG. 14. The rib 68, 68' grows deeper as the front of the tooth is abraded away, however the angle presented by the front of the tooth remains at the slope illustrated in FIG. 14. This abrasive action and wear pattern causes the tooth to remain in sharpened condition as the tooth is worn away while digging in the ground, and thereby greatly increases the usefulness thereof.

The rib 68 provides the tooth with great strength and an unexpected long life. The unexpected wear pattern of the digging tooth provides a tooth that needs no sharpening during the useful life thereof.

The forward end of the tooth of FIGS. 3 and 5 will eventually abrade away into a configuration similar to the leading edge 59 seen in FIG. 14.

I claim:

1. An improved non-rotatable, dirt type excavating tooth in combination with a support block of the type having a cylindrical bore formed therein which rotatably receives a prior art rotatable type rock bit;

said excavating tooth has a longitudinal axis and includes a cylindrical shank at one end thereof and a relatively wide ground engaging blade at the other end thereof, said shank describes a circle in cross-section and is made complementary respective to the support block bore so that said shank can be telescopingly received in a captured manner within the bore of the block, thereby removably mounting said excavating tooth respective to the block;

said excavating tooth and block include means thereon that forms a locking device which is located at a medial portion thereof when the tooth and block are assembled; said locking device includes a male abutment member on said tooth and a female abutment member on said block; said male abutment member is formed at the rear of the blade and separates the blade form the shank;

said male abutment member includes a plurality of wall surfaces connected together to form part of a polygon, with the central axis of the polygon coinciding with the longitudinal axis of the shank;

said female abutment member is spaced from said bore and includes means on said block for selectively receiving at least one of said wall surfaces of said male abutment member therewithin and in abutting engagement therewith in a manner which prevents the tooth shank from being rotated axially within the bore of the block.

2. The combination of claim 1 wherein said polygon of said male abutment member is three sides of an octagon;

said female abutment member is a shoulder extending from said block and confronts at least one of the three sides of said male abutment member; whereby, the confronting sides of the male and female abutment members abuttingly engage one another in a manner to prevent rotation of the tooth shank within the block bore.

3. The combination of claim 2 wherein said female abutment member forms three shoulders having surfaces which confront the three surfaces of the male abutment members when the second of the tooth shoulders is aligned with the second of the block shoulders.

4. The combination of claim 1 wherein said tooth blade has a front end and a rear end, a concave top surface, with there being opposed cavities formed on the lower surface thereof that leaves a longitudinal rib that extends from the front end of the blade downwardly and rearwardly to the rear end of the blade.

5. The combiantion of claim 4 wherein said male abutment member is at least partially received within said block, there being a shoulder on the tooth and a shoulder on the block which abuttingly engage one another when the shank of the tooth is received within the bore of the block.

6. The combination of claim 1 wherein said male abutment member is at least partially received within at least part of said block, there being a shoulder on the tooth and a shoulder on the block which slidably engage one another when the tooth shank is received within the block bore.

7. The combination of a non-rotatable dirt type excavating tooth and a support block therefor; said support block includes a cylindrical bore which rotatably receives a cylindrical shank of a prior art rotatable type rock bit in mounted relationship therewithin;

said tooth has a cylindrical shank made complementary respective to the block bore so that said shank can be telescopingly received in a captured manner within the bore of said support block, thereby removably mounting said excavating tooth respective to the support block;

said tooth includes a blade-like ground engaging member opposed to said shank; means forming a locking device at a medial part of the tooth and the forward end of the block by which the tooth is rendered non-rotatable respective to the block;

said locking device includes abutment means having at least one sidewall that extends from attached relationship respective to said block and forms at least one inwardly directed shoulder; said locking device further includes abutment means on said tooth that extends from attached relationship respective to the tooth and forms a plurality of outwardly directed shoulders spaced from the bore of the holder and which forms an included obtuse angle therebetween, said shoulders are positioned perpendicularly respective to a radial line extending from the central longitudinal axis of the block bore, said locking device on the block includes a projection which extends forwardly of the block and slidably receives in a selective manner at least one tooth shoulder thereagainst, thereby preventing axial rotation of said tooth respective to said block.

8. The combination of claim 7 wherein said tooth shoulders jointly form part of a polygon.

9. The combination of claim 7 wherein said abutment means on said block forms three adjacent shoulders which confront the three sides of the abutment means on said tooth when the second shoulder of the tooth is aligned with the second shoulder of the block.

10. The combination of claim 7 wherein said tooth has a front end opposed to a rear end, said blade has a concave upper surface, and opposed cavities formed on the lower surface thereof that leaves a longitudinal rib extending from the front end of the tooth downwardly and rearwardly to the rear end of the blade.

11. The combination of claim 10 wherein said abutment means on said block forms three shoulders which confront the three sides of the abutment means on said tooth when the second shoulder of the tooth is aligned with the second shoulder of the block.

12. The combination of claim 8 wherein said polygon of said tooth abutment member is three sides of an octagon; said block abutment means forms the three shoulders which confront the three sides of the tooth abutment member when the second shoulder of the tooth abutment member is aligned with the second side of the block abutment member.

13. An improved non-rotatable, dirt type excavating tooth for use in a support block having a cylindrical bore formed therein, said block bore is round in cross-section and can rotatably receive a rotatable type prior art bit;

said excavating tooth has a cylindrical shank at one end thereof which is opposed to a ground engaging member at the other end thereof, said shank being made complementary respective to the support block bore, said shank is telescopingly received in a captured manner within the bore of the support block thereby removably mounting said excavating tooth respective to the support block;

said excavating tooth includes a ground engaging blade member which forms the leading marginal end thereof; means forming an abutment member at a medial portion of the tooth defined by the area where the round shank is joined to the blade member;

said abutment member is spaced from said axial bore and includes a plurality of shoulders having outwardly directed surfaces that define a segment of a polygon, the polygon has a center coinciding with the longitudinal axis of the shank;

means on said block forming another abutment member which is spaced from said block bore and includes at least one shoulder formed forwardly of the entrance to the block bore and arranged to slidably engage in a selective manner either of the surfaces of said polygon, so that said tooth can be placed within said bore and oriented into one of several axial positions.

14. In an excavating machine having a plurality of tooth receiving support blocks mounted thereon for movement to thereby provide for an excavation operation when digging teeth are mounted to the blocks, each support block includes spaced outer wall surfaces, and a cylindrical bore for rotatably receiving a cylindrical shank of a prior art rotatable type bit; the combination of said support block with a non-rotatable dirt type excavating tooth;

said excavating tooth includes a cylindrical shank at one end thereof made complementary respective to the block bore, said shank is round in cross-section and has a longitudinal axis, said shank is telescopingly received with the bore of said support block, thereby removably mounting said excavating tooth respective to said block;

said tooth includes a blade-like ground engaging member at the other end thereof, and a male abutment means formed at a medial portion thereof which separates the blade member from the shank;

a female abutment means formed on said block for engaging said male abutment means of said tooth and thereby preventing axial rotation of said tooth when the tooth shank is received within the block bore; said female abutment means is spaced from the block bore; said male abutment means is spaced from said shank and is in the form of a segment of a polygon having a center which lies along the longitudinal axis of said shank;

said tooth can be removed from the block, axially rotated into one of a plurality of axial positions respective to the block, and mounted within the bore of the support block; thereby preventing axial rotation of said blade-like ground engaging member respective to said block.

15. The excavating machine of claim 14 wherein said polygon of said male abutment means forms three sides of an octagon.

16. The excavating machine of claim 15 wherein said female abutment means forms three shoulders which confront the three sides of the male abutment means when the second shoulder of the male abutment means is aligned with the second side of the female abutment means.

17. The excavating machine of claim 14 wherein said tooth blade has a concave upper surface, and opposed cavities formed on the lower surface thereof that leaves a longitudinal rib, said rib extends from the front end of the tooth downwardly and rearwardly to the rear end of the blade.

18. The excavating machine of claim 17 wherein said male abutment means is received within the female abutment means of said block, there being a shoulder on the tooth abutment means and a shoulder on the block abutment means which abuttingly engage one another when the tooth shank is received within the block bore.

* * * * *

UNITED STATES PATENT AND TRADEMARK OFFICE

CERTIFICATE OF CORRECTION

PATENT NO. : 4,727,664

DATED : March 1, 1988

INVENTOR(S) : CHARLES W. HEMPHILL

It is certified that error appears in the above-identified patent and that said Letters Patent is hereby corrected as shown below:

Column 6, line 33, delete "25" before 20';

Column 8, line 6, substitute --member-- for "members";

Column 10, line 9, substitute --within-- for "with".

Signed and Sealed this

Eleventh Day of October, 1988

*Attest:*

*Attesting Officer*

DONALD J. QUIGG

*Commissioner of Patents and Trademarks*